United States Patent [19]

Chisnall

[11] 4,031,658

[45] June 28, 1977

[54] CHILD'S RATTLE

[76] Inventor: David William Chisnall, Thirlestane, Stadhampton, Oxfordshire, England

[22] Filed: June 7, 1976

[21] Appl. No.: 693,556

[30] Foreign Application Priority Data

June 11, 1975 United Kingdom ..... 25088/75

[52] U.S. Cl. ..... 46/191; 46/193

[51] Int. Cl.[2] ..... A63H 5/00

[58] Field of Search ..... 46/1 R, 32, 191, 193

[56] References Cited

UNITED STATES PATENTS

| | | | |
|---|---|---|---|
| 1,148,451 | 7/1915 | Gosliner | 46/191 |
| 2,268,683 | 1/1942 | Zadek et al. | 46/193 |
| 3,913,262 | 10/1975 | Chisnall | 46/193 |

*Primary Examiner*—Louis G. Mancene
*Assistant Examiner*—Robert F. Cutting
*Attorney, Agent, or Firm*—Emory L. Groff, Jr.

[57] ABSTRACT

A child's rattle made of synthetic plastics from three components which can be assembled easily and which consists of a hollow bell-like member, a tube arranged to pass through aligning holes through the member and which engages the member by a snap fit to lock to same, and a clapper for mounting on the tube within the bell-like member. The tube enables a number of the rattles to be strung on a cord as a pram toy.

4 Claims, 2 Drawing Figures

CHILD'S RATTLE

BACKGROUND OF THE INVENTION

This invention concerns a child's rattle and it has for an object to provide a rattle of simple and robust construction and which can be assembled easily, and one in which an end is open so that the clapper can be seen. Another object is to provide a rattle which is built up from a number of components and with which when assembled, there is no possibility of components being separated. A further object is to provide a rattle so that a number of such rattles can be strung on a cord, thereby to provide a toy which can be secured across a pram, cot or the like.

SUMMARY OF THE INVENTION

According to the invention the child's rattle comprises a bell-like member, two oppositely disposed apertures through the wall thereof on a common axial line near to its closed end, a tubular shaft passing through said apertures and member, means at an end of said shaft lockingly engaging the member at one aperture, and a clapper having an eye through which said shaft passes within the member.

The rattle according to the invention can be assembled easily. The non-locking shaft end is passed through one aperture and the clapper engaged within the bell member, the shaft then being pushed axially until said non-locking end passes out of the other aperture and the locking end engages the member at the other aperture the shaft being firmly held against substantial axial displacement and the clapper free to swing thereon.

The locking means conveniently comprises two spaced apart circumferential ribs near an end of the shaft and the shaft has a slit or cut-out through its wall near this end, which slit or cut-out interrupts the innermost rib, whereby on assembly, when the shaft is inserted, said non-locking end passes out of said other aperture, and the shaft flexes so that the innermost rib passes through the one aperture, the shaft being held firmly against axial displacement with one rib on the outer surface of the member, the other on the inner surface thereof. Preferably the leading side of the inner rib is inclined or bevelled to facilitate the passage of said rib through the aperture.

Preferably the components are of a hard synthetic plastic material, the shaft being sufficiently resilient to flex.

BRIEF DESCRIPTION OF THE DRAWINGS

An embodiment according to the invention is illustrated in the accompanying drawings, in which:-

DESCRIPTION OF PREFERRED EMBODIMENTS

Figure 1:
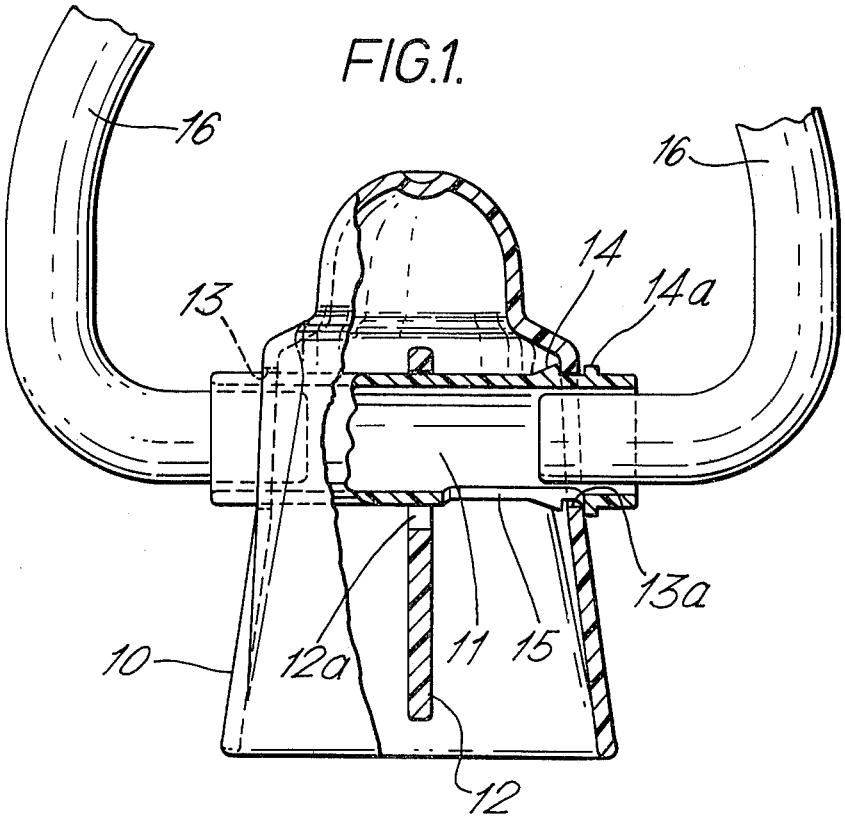
FIG. 1 is an elevation of the rattle partly broken away.

As shown in the drawings, the rattle consists of a bell-like hollow member 10 with a dome top, a tubular shaft 11, and clapper 12 all made of a synthetic plastic material. The member 10 has apertures 13, **13*a*** therethrough these being circular and with their centres on a common axial line.

Figure 2:
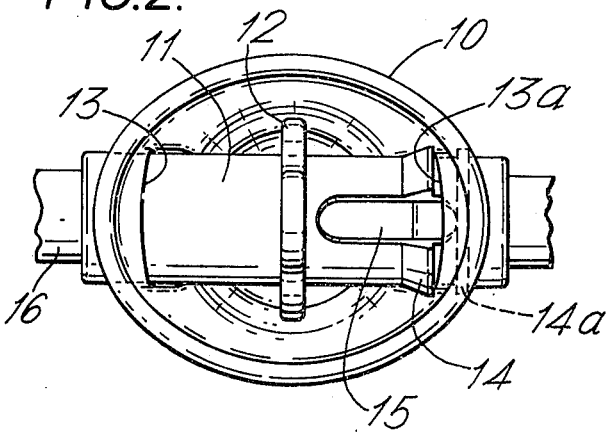
FIG. 2 is an underneath plan view of FIG. 1.

As will be seen from FIG. 2, the member 10 is of ovoid shape in plan and the apertures are on the major axis.

The shaft is plain at its one non-locking end and has two spaced apart circumferential ribs 14, **14*a* near the other end and also a longitudinal slot 15 at this other end the outer end of which is located at the rib 14*a***. The ribs need not necessarily be continuous. They could be interrupted i.e. each comprise a plurality of spaced apart projections.

The clapper 12 consists of a flat component with an eye **12*a*** at one end.

In assembling the rattle, the plain end of the shaft is inserted through the aperture **13*a* and the eye 12*a* slipped thereover in the member 10, the shaft being pushed through until its plain end passes out of the aperture 13 when the rib 14 meets the outer surface of the member 10. The leading surface of the rib 14 towards said surface is inclined or bevelled so that continued firm pushing results in the shaft flexing in at the location of the rib 14 due to the slot, until the rib 14 passes through the aperture 13*a* when the shaft snaps back. The facing surfaces of the ribs 14 and 14*a*** are substantially normal to the shaft axis thus preventing the shaft, when once in position, from being removed, the ribs forming a circumferential groove between them.

The rattle as above may be carried by a D-ring, part 16 of which is shown in FIG. 1. A plurality of rattles can also be strung on a cord to form a rattle toy for suspension across a perambulator or cot.

I claim:

1. A child's rattle comprising a bell-like member, two oppositely disposed apertures through the wall thereof on a common axial line near to its closed end, a tubular shaft passing through said apertures and member, means at an end of said shaft lockingly engaging the member at one aperture, and a clapper having an eye through which said shaft passes within the member.

2. A child's rattle as claimed in claim 1, comprising a tubular shaft, two spaced apart ribs at an end of the shaft and a slit through said shaft interrupting the innermost rib with respect to said end.

3. A child's rattle as claimed in claim 2, comprising a bevel on the leading side of said innermost rib.

4. A child's rattle as claimed in claim 3, comprising also a D-ring each end of which engages within one end of the shaft.

* * * * *